United States Patent [19]

Mullins

[11] 4,093,174

[45] * June 6, 1978

[54] COMBINATION DIE AND PALLET

[76] Inventor: Wayne L. Mullins, 5001 E. Cactus, Scottsdale, Ariz. 85254

[ * ] Notice: The portion of the term of this patent subsequent to Dec. 21, 1993, has been disclaimed.

[21] Appl. No.: 730,138

[22] Filed: Oct. 6, 1976

Related U.S. Application Data

[63] Continuation-in-part of Ser. No. 681,419, Apr. 29, 1976, Pat. No. 3,998,423.

[51] Int. Cl.[2] ..... B28B 7/24; B28B 7/26

[52] U.S. Cl. ..... 249/120; 249/119; 425/DIG. 118

[58] Field of Search ..... 249/119, 120, 129

[56] References Cited

U.S. PATENT DOCUMENTS

| | | | |
|---|---|---|---|
| 986,266 | 3/1911 | Carter et al. | 249/119 |
| 3,998,423 | 12/1976 | Mullins | 249/120 |

*Primary Examiner*—J. Howard Flint, Jr.

*Attorney, Agent, or Firm*—Herbert E. Haynes, Jr.; John A. Robertson

[57] ABSTRACT

A combination die and pallet of honeycombed construction comprising an upper rectangular die plate having frusto pyramidal depressions stamped therein and side and end flanges integrally joined to and depending from the die plate together with a base plate of the same size and shape as the die plate having side and end flanges upstanding therefrom and overlapped by the flanges on the die plate and formed with longitudinal ribs pressed therefrom and extending between rows of depressions in the die plate with the base plate being spot welded on the bottom of the depressions and the overlapping flanges being welded together.

10 Claims, 12 Drawing Figures

COMBINATION DIE AND PALLET

This application is a continuation-in-part of the copending application of Wayne L. Mullins, Ser. No. 681,419, filed Apr. 29, 1976, and entitled: "Combination Die and Pallet", which issued on Dec. 21, 1976 as U.S. Pat. No. 3,998,423.

The present invention relates to dies which are used in forming conical projections on building blocks and is concerned primarily with such a die which is of a honeycombed construction to impart to the die the ability to function as a pallet for subsequent handling of building blocks after an upper die part is removed.

BACKGROUND OF THE INVENTION

At the present time, interlocking building blocks of rectangular shape have conical recesses in their lower faces and complemental conical projections on their upper faces. The recesses and projections are ordinarily arranged in similar patterns of two rows with four elements in each row which are all equidistantly spaced apart so that the four recesses and projections at each end define a square and the four central or intermediate recesses and projections define a square of the same size and shape as the end squares.

These building blocks are of a cementitious material and are ordinarily formed in molds which from the view point of efficiency of production casts a plurality of the blocks on a single operation. Such molds include as an essential element, a lower die plate which is formed with a plurality of frusto conical recesses which form projections on the blocks. The recesses in the blocks themselves are formed by apparatus and steps which are not a part of the present invention.

After a block has been cast, an upper mold part is removed and the blocks are subject to subsequent handling. It is the practice to remove the blocks from the upper die plate and cure them on a pallet so that they can be handled in multiple lots. The lower die plates which are now known and available are not shaped and sufficiently strong and rigid to permit them for use as a pallet for this subsequent handling of the blocks.

OBJECTS OF THE INVENTION

With the foregoing conditions in mind the present invention has in view the following objectives:

1. To provide a combination die and pallet which is of a honeycombed construction which provides sufficient strength and rigidity to accommodate handling of a plurality of blocks after casting and setting.

2. To provide a combination die and pallet, of the type noted, which includes as a characteristic and essential element an upper die plate having a plurality of frusto pyramidal depressions stamped therein and arranged to provide the projections on a plurality of building blocks which are molded on the die plate.

3. To provide, in a combination die and pallet of the character aforesaid, which is rectangular and the depressions are arranged in longitudinal and transverse rows to accommodate a plurality of blocks which are molded on the plate.

4. To provide, in a combination die and pallet of the kind described, a die plate having side and end flanges integral with the die plate.

5. To provide, in a combination die and pallet of the type noted, a base plate of the same size and shape as the die plate and formed with a plurality of longitudinal ribs which when the two plates are assembled assume a position between longitudinal rows of the depressions in the die plate.

6. To provide, in a combination die and pallet of the character aforesaid, a base plate having upstanding side and end flanges which are welded to lower edge portions of the flanges of the die plate with the base plate being spot welded to the bottom walls of the depressions in the die plate.

Various other more detailed objects and advantages of the invention, such as arise in connection with carrying out the above ideas in a practical embodiment will, in part, become apparent and, in part, be hereinafter stated as the description of the invention proceeds.

SUMMARY OF THE INVENTION

The foregoing objects are achieved by providing a combination die and pallet which comprises a die plate of rectangular shape and dimensioned to accommodate the casting of a plurality of building blocks thereon. The die plate is formed with a plurality of fruso pyramidal depressions each having inclined side walls and a bottom wall. These depressions are arranged in longitudinal and transverse rows and are spaced apart in accordance with the pattern of the projections which are to be formed on each block. Depending from the side and end edges of the die plate are side and end flanges which are integral with the die plate and which have a height substantially equal to the depth of the depressions.

A base plate of the same size and shape as the die plate is formed with a plurality of longitudinal ribs which upstand therefrom, that is toward the die plate, and when the two plates are assembled assume positions between longitudinal rows of the depressions with a rib being located between each side edge and the row of depressions adjacent thereto. The base plate is formed with side and end flanges upstanding therefrom and partially overlapping the side and end flanges on the die plate with the overlapped portions being welded together. The base plate is also spot welded to the bottom walls of the depressions.

For a full and more complete understanding of the invention, reference may be had to the following description and accompanying drawings wherein.

DESCRIPTION OF THE PREFERRED EMBODIMENT

Figure 1:
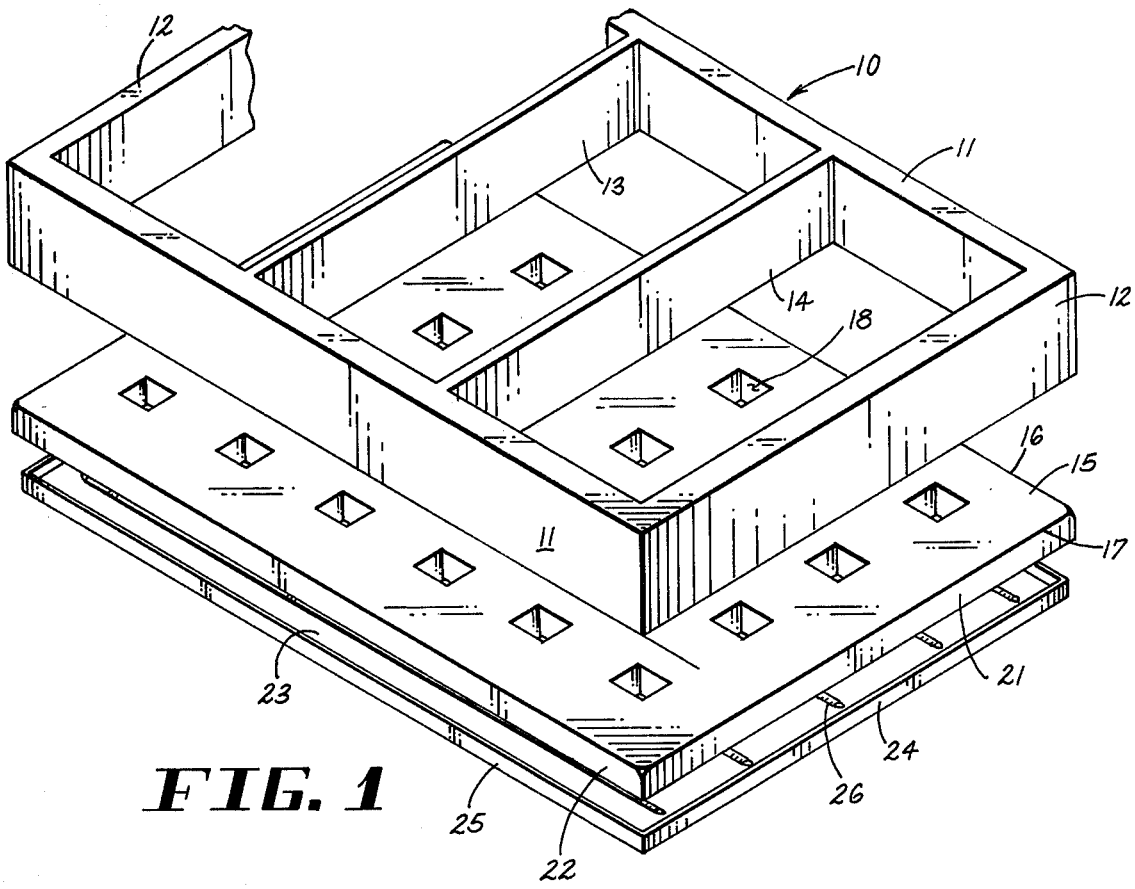
FIG. 1 is a perspective illustrating an upper mold part, a die plate which is associated therewith and a base plate in exploded relation.

Before entering into a detailed description of the three die and pallet assemblies illustrated in the drawings it is noted that in the preferred embodiment of the invention the die and pallet are designed to accommodate three building blocks each of which is formed with eight projections on what is the lower face during the molding operation but what becomes the upper face in an actual building construction. These eight projections are arranged in two rows of four each with the four projections at one end defining a square, the four projections at the other end another square and the four intermediate or central projections a square of the same size and shape as the aforesaid end squares.

Figure 2:
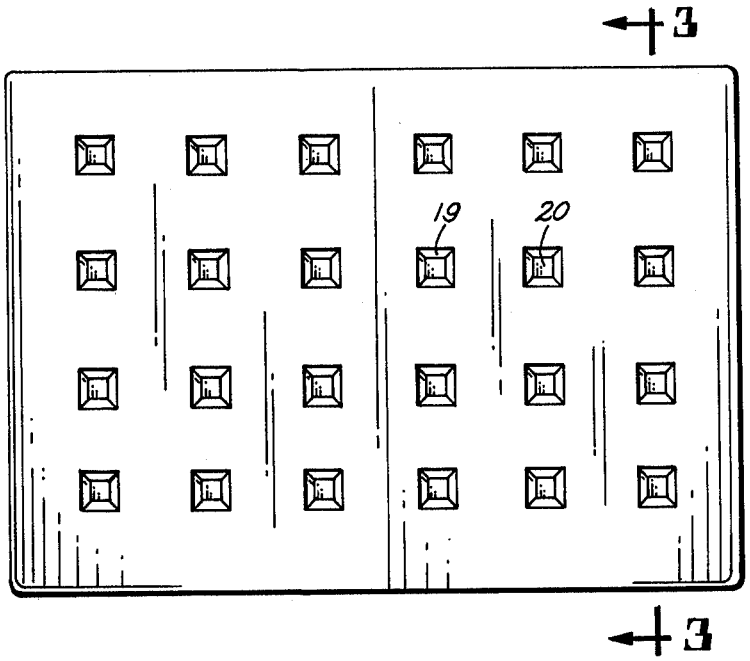
FIG. 2 is a top plan view of the die plate.
Figure 3:
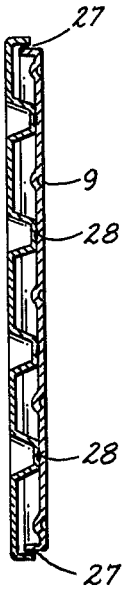
FIG. 3 is a transverse cross section of the combination die and pallet illustrating the base plate as assembled on the die plate, taken on the plane of line 3—3 of FIG. 2.

In accordance with the disclosures of FIGS. 1, 2, and 3, the pallet and die is designed to accommodate three of the above described building blocks. An upper mold part is designated 10 and it in itself is not a part of the present invention although it is related thereto. Thus, mold part 10 comprises side walls 11, end walls 12, and partitions 13 and 14 which extend between side walls 11. The present invention is concerned solely with the forming of projections on the lower face of the building block and is not concerned particularly with how recesses for receiving complemental projections of other blocks are formed on the upper face.

A die plate is designated 15. It is rectangular in shape and is defined by side edges 16 and end edges 17. As blocks are being molded the mold part 10 will rest on die plate 15 with the lower faces of walls 11 and 12 resting on the upper face of die plate 15 immediately adjacent to edges 16 and 17.

Die plate 15 is formed with 24 frusto pyramidal depressions which are stamped thereinto by a well known metal stamping operation and each of which is referred to in its entirety as 18. Each depression 18 is defined by four inclined side walls 19 which together constitute a frusto pyramidal wall and a bottom wall 20.

Die plate 15 ordinarily is of metal and end flanges 21 and side flanges 22 are formed integrally therewith. These flanges 21 and 22 have a height slightly less than the depth of depressions 18.

Base plate 23 is of substantially the same size and shape as die plate 15. It has end flanges 24 and side flanges 25. Extending longitudinally of base plate 23 that is in directions parallel to side flanges 25 are ribs 26 which are formed by deforming the metal of base plate 23 leaving grooves 9 on the under face (FIG. 3). It will be noted that the ends of ribs 26 are spaced inwardly from the end flanges 24 a slight distance to accommodate the thickness of flanges 21 which engage the upper face of base plate 23 immediately within end flanges 24. Upper portions of end flanges 24 and side flanges 25 of base plate are partially overlapped by end flanges 21 and side flanges 22 of the die plate and welded together at the overlap.

It is important to note that the outermost of the ribs 26 assume a position between side flanges 22 and the longitudinal rows of depressions 18 immediately adjacent thereto. The three intermediate ribs 26 assume positions between the four longitudinal rows of depressions 18.

The welding of the flanges 24 and side flanges 25 of base plate 23 to the flanges 21 and 22 of die plate 15 is represented at 27. When so assembled, base plate 23 engages the bottom walls 20 of depressions 18 and is spot welded thereto as indicated at 28. It is evident that with the mold part 10 resting on the die plate 15 in the manner above described cementitious material may be poured into the three chambers defined by partitions 13 and 14 and this material will enter the depressions 18. After the material is set mold part 10 is removed leaving three blocks resting on die plate 15. The latter due to its assembly with base plate 23 is now constituted a pallet which supports the three blocks for subsequent handling and manipulation thereof. This strength and rigidity in the pallet is imparted by the honeycomb construction afforded by depressions 18 and ribs 26.

FIRST MODIFICATION

Figure 4:
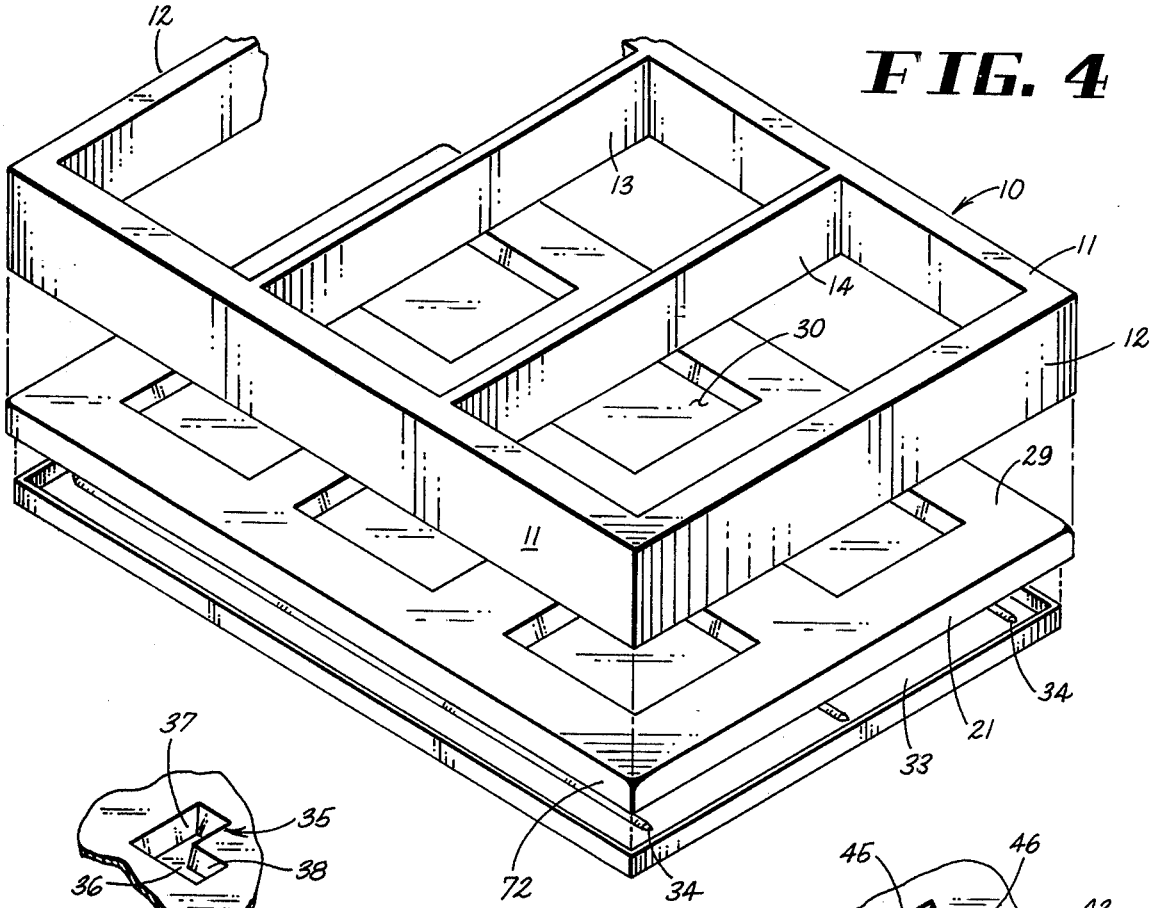
FIG. 4 is a perspective of a modification illustrating the elements thereof in exploded relation.
Figure 5:
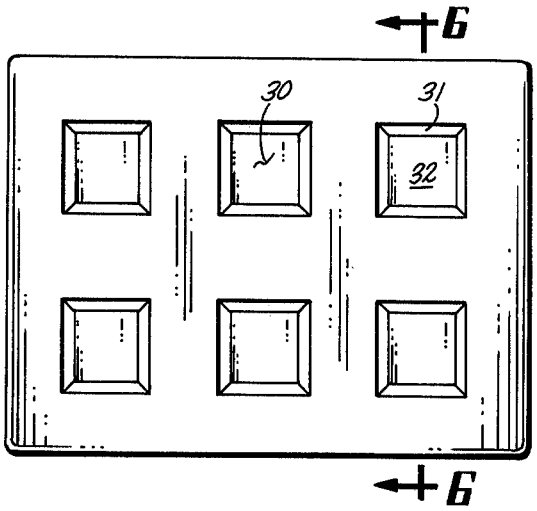
FIG. 5 is a top plan view of die plate of FIG. 4.
Figure 6:
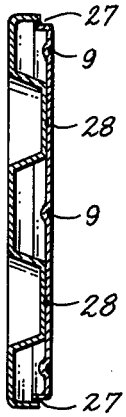
FIG. 6 is a transverse vertical section through the die plate and base plate of FIG. 4 as assembled, being taken on the plane of line 6—6 of FIG. 5.

Referring now more particularly to FIGS. 4, 5, and 6, a modified embodiment of the invention will be described. Certain interlocking building blocks are formed with only two depressions on one face and two complemental projections on the other face. FIGS. 4, 5, and 6, illustrate a combined die and pallet which is designed to accommodate three such blocks.

FIG. 4 illustrates a mold part 10 which is identical with the mold part 10 described in FIG. 1 and has the same function. A die plate 29 is of the same size and shape as of die plate 15 of FIGS. 1, 2, and 3, and has the same end and side flanges 21 and 22. However, it is formed with six depressions each of which is identified in its entirety by the reference character 30. Each of these depressions 30 is defined by four inclined walls 31 and a bottom wall 32. These walls cooperate to define a frusto pyramidal depression. These six depressions are arranged in two rows of three each with each row being spaced from and parallel to a side flange 22. A base plate 33 is of the same size and shape as die plate 29. It is formed with three longitudinal ribs 34 with the central rib being disposed between the two longitudinal rows of depressions 30 and the outside ribs are positioned between the side flanges 22 and the adjacent longitudinal rows of the depressions 30.

Base plate 33 is welded to die plate 29 in the same manner as is base plate 23 welded to die plate 15. The weldings at 27 and 28 being the same in both instances.

It is evident that with the mold part 10 and combined die and pallet of FIGS. 4, 5, and 6 the projections formed on the block will be solid and have continuous bottom surfaces. However, the same die and pallet assembly may be used to form blocks with projections in the form of side or annular walls. This construction is achieved by employing proper mold elements which would be included as a part of the mold 10.

MODIFICATION OF THE DEPRESSION IN THE DIE PLATE

Figure 7:
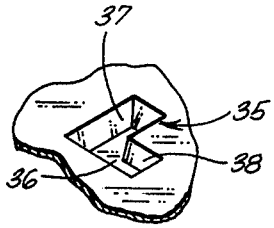
FIG. 7 is a detailed perspective of a modified form of depression in the die plate.

FIG. 7 illustrates a modified form which the depressions in the die plate may take. The depression is designated generally at 35. It is L-shaped and comprises a bottom wall 36 and two inclined long walls 37 and four inclined short walls 38. It is believed that this wall structure defines a frusto pyramid.

Figure 8:
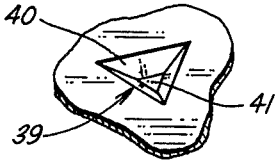
FIG. 8 is another detailed perspective of a second modification of the depressions in the die plate.

FIG. 8 discloses an equilateral triangular frusto pyramidal depression designated 39 comprising three flat side walls 40 and a bottom wall 41.

Figure 9:
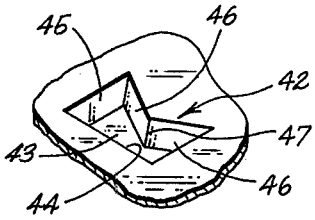
FIG. 9 is another detailed perspective of a third embodiment of the depressions in the die plate.

FIG. 9 illustrates another depression designated generally 42 comprising a flat bottom 43, a long inclined side wall 44, two inclined end walls 45 and two short inclined side walls 46 which meet on an apical line 47.

FINAL EMBODIMENT

Figure 10:
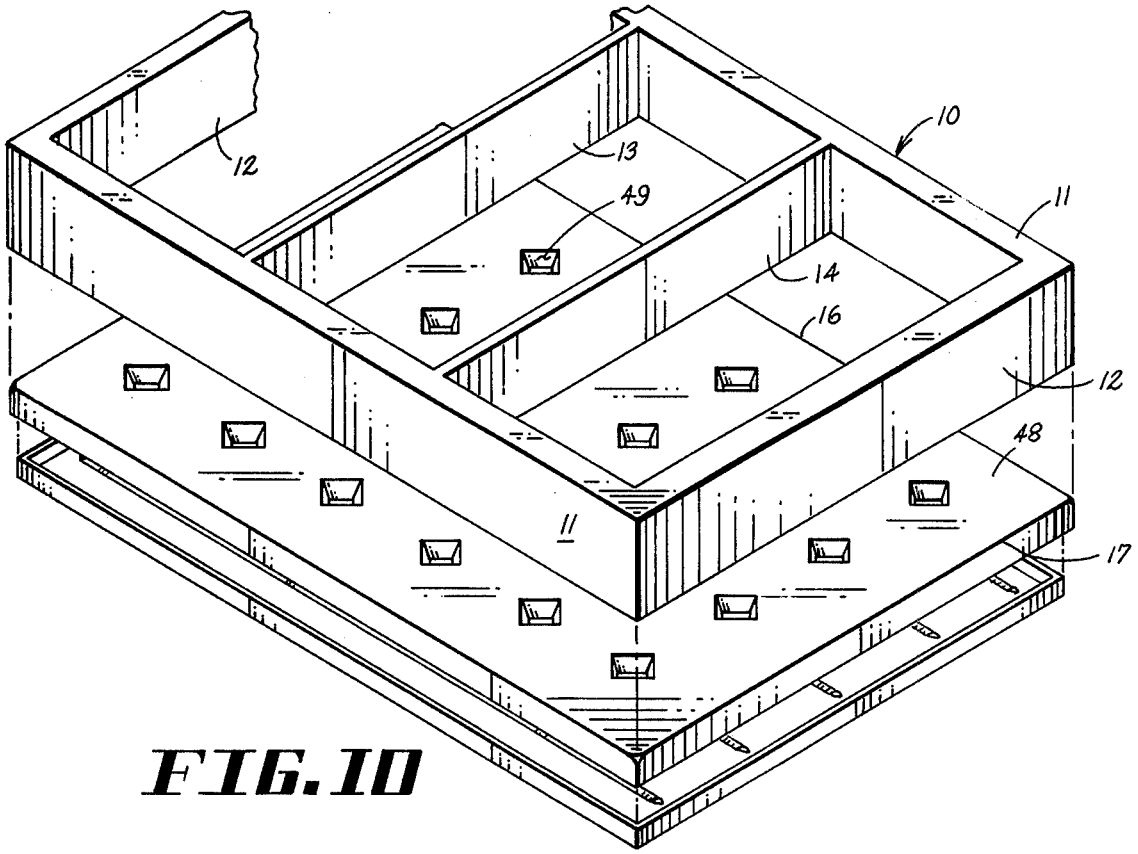
FIG. 10 is a perspective similar to FIG. 1 illustrating an upper mold part, a die plate which is associated therewith, a base plate in exploded relation with the square pyramidal depressions of FIG. 1 shown as rotated 90° as compared to the projections of these square pyramidal depressions of FIG. 1.
Figure 11:
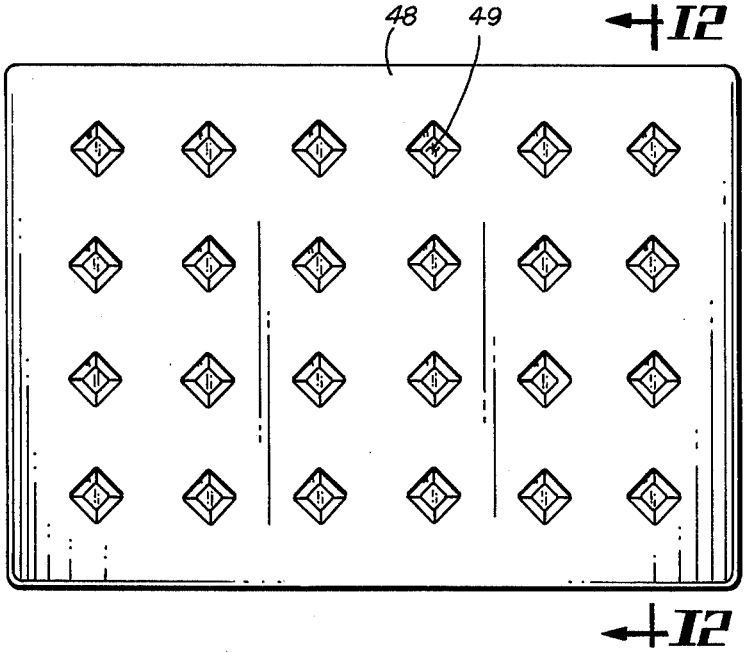
FIG. 11 is a top plan view of the die plate of FIG. 10.
Figure 12:
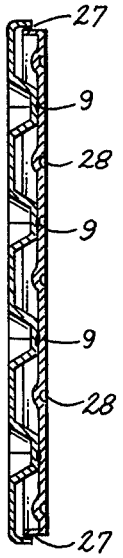
FIG. 12 is a transverse vertical section of the combination die and pallet as assembled and taken on the plane of the line 12—12 of FIG. 11.

Referring now more particularly to FIGS. 10, 11, and 12 there is therein illustrated a die plate 48 which corresponds in size and shape to die plate 15 having side edges 16 and end edges 17. Die plate 48 is formed with 24 depressions 49 which are believed to be best described as a square pyramidal depression. Standing alone the depressions 49 are substantially the same as depressions 18 of FIGS. 1, 2, and 3. However, the side walls 19 of depressions 49 are not parallel to the side edges 16 and end edges 17 as they are in FIGS. 1, 2, and 3, but are disposed at angles of 90° relative to these side and end walls.

While preferred specific embodiments of the invention are herein disclosed, it is to be clearly understood that the invention is not limited to the exact constructions, designs, and materials illustrated and described because various modifications of these details may be provided in putting the invention into practice.

I claim:

1. In a combination die and pallet of honeycomb construction;

(a) a die plate of rectangular shape presenting end and side edges and formed with a plurality of depressions arranged in longitudinal rows, (b) each of said depressions being defined by a frusto pyramidal wall and a flat bottom, (c) end flanges depending from said end edges and side flanges depending from said side edges, said flanges being integral with said die plate, having lower edges, and of a height slightly less than the depth of said depressions, (d) a rectangular base plate of the same size and shape as said die plate and presenting end and side flanges, (e) fused joints between those portions of the side and end flanges on the die plate which overlap portions of the side and end flanges of the base plate, (f) spot fusions between said base plate and the bottoms of said depressions, and (g) a plurality of longitudinal ribs upstanding from said base plate and pressed therefrom leaving grooves opening onto the lower face of said base plate, said ribs being parallel to the side edges of said plates and alternately disposed between said side edges and said longitudinal rows of depressions.

2. The combination die and pallet assembly of claim 1 which is dimensioned to accommodate three building blocks of the same thickness and each having a length twice as long as its width.

3. The combination die and pallet of claim 2 in which there are 24 of said depressions with there being four longitudinal rows of six of said depressions.

4. The combination die and pallet of claim 2 in which there are six of said depressions with there being three longitudinal rows of two of said depressions.

5. The combination die and pallet assembly of claim 1 in which the die and base plates are of metal and the fused joints between the flanges of the die and base plates are welds and the spot fusions are spot welds.

6. The combination die and pallet assembly of claim 1 in which each of the frusto pyramidal walls is defined by four inclined wall sections arranged to define a square.

7. The combination die and pallet assembly of claim 1 in which the frusto pyramidal assembly wall is of L-shape.

8. The combination die and pallet assembly of claim 1 in which the frusto pyramidal wall is triangular.

9. The combination die and pallet assembly of claim 1 in which the frusto pyramidal wall comprises a long inclined side wall section, two inclined end wall sections, and two inclined side wall sections which meet at an apical line.

10. The combination die and pallet assembly of claim 6 in which the wall secions are disposed at angles of 90° relative to the side and end edges of the die pallet.

* * * * *